United States Patent [19]

Champoux

[11] Patent Number: 5,054,736

[45] Date of Patent: Oct. 8, 1991

[54] LAPTOP READING AND WRITING STAND

[76] Inventor: Bruno Champoux, 5187 Berri Street, Apt. 3, Montreal, Canada, H2J 2S4

[21] Appl. No.: 531,774

[22] Filed: Jun. 1, 1990

[51] Int. Cl.[5] ..... A47B 97/00

[52] U.S. Cl. ..... 248/444; 248/451; 248/456

[58] Field of Search ..... 248/444, 449, 451, 465, 248/453, 455, 456, 461; 108/43

[56] References Cited

U.S. PATENT DOCUMENTS

| | | | |
|---|---|---|---|
| 578,325 | 3/1897 | Fleming | 248/456 |
| 756,486 | 4/1904 | Fleming | 248/456 |
| 1,238,594 | 8/1917 | Stresing | 248/449 |
| 1,305,853 | 6/1919 | Widmer | 248/444 |
| 1,947,053 | 2/1934 | Mason . | |
| 2,273,361 | 2/1942 | Kozloff . | |
| 2,294,563 | 9/1942 | Lamar . | |
| 2,471,003 | 5/1949 | Monahan | 248/444 X |
| 2,489,553 | 11/1949 | Wofford | 248/449 X |
| 2,501,019 | 3/1950 | Attick . | |
| 2,826,857 | 3/1958 | Saunders | 248/456 |
| 2,975,544 | 3/1961 | Lutterberg | 248/451 |
| 3,015,906 | 1/1962 | Guth | 248/449 |
| 3,027,070 | 4/1962 | Norvell . | |
| 3,122,858 | 3/1964 | Kadin . | |
| 3,920,213 | 11/1975 | Hanson, Jr. | 248/455 X |
| 3,991,967 | 11/1976 | Sack | 248/453 X |
| 4,116,413 | 9/1978 | Andersen . | |
| 4,119,289 | 10/1978 | Kanoez . | |
| 4,436,271 | 3/1984 | Manso | 248/456 X |
| 4,726,556 | 2/1988 | Weir . | |

FOREIGN PATENT DOCUMENTS

| | | | |
|---|---|---|---|
| 85960 | 4/1896 | Fed. Rep. of Germany | 248/456 |
| 1037762 | 9/1953 | France | 248/456 |
| 13592 | of 1903 | United Kingdom | 248/451 |

*Primary Examiner*—David L. Talbott

[57] ABSTRACT

This stand is to be placed on one's lap to operatively support a book, newspaper, papers, or the like for reading or writing, and this is particularly constructed and arranged to be easily actuated by the user himself while using it, which allows to conveniently position and hold a newspaper or other papers and that readily collapses flat on one's lap to form a table for writing. This stand comprises a base panel, a worktable panel and an inclination adjustment leg pivoted on the base, a series of stoppers against the back of the worktable panel and selectively engageable by the free outer end of the leg, and a workholder bar assembly to conveniently hold and position a book newspaper, papers, or the like.

2 Claims, 3 Drawing Sheets

31c 31d 31 31c
31b 14 15
31a
11a
A
30 29
30b
31 30a 25 29

5
7
30a
8
4
A
31 29 33a
31 33 32 33a
34 26 27 12
31a 31b
13a
14
11a 11

35 28 36
42 40 34
4
6
6
9
9
37 28a
11a
11
26 27 25 14 15

11
33 33b 33d
31 13
31b
31c 31d
33a 30 29 25

LAPTOP READING AND WRITING STAND

FIELD OF THE INVENTION

The present invention relates to a stand for a book, newspaper, papers, or the like to provide a sitting person with some convenience for reading and writing.

BACKGRQUND OF THE INVENTION

Stands of the above-mentioned type which have been disclosed in prior patents relate to different functional and structural features and modes of operation. It must be noted that the basic purpose or object of such stand is to provide convenience to any user and, in particular, to sick, old, or handicapped persons, such that a book, newspaper or papers may be conveniently placed in proper position and then held fast in that position to free or replace the hands, such as to supplement their lack of sturdiness.

The U.S. Pat. No. 2,273,361 to Kozhoff defines a stand of the above-mentioned type which is characterized by a board and a base which can be moved one relative to the other and by pairs of slides, knobs, and screws to adjust the inclination of the board, the height of a ledge to carry a book or the like, and the fore and aft translation of the base relative to the boards. Such assembly presents disadvantages associated with the use of the pairs of actuation knobs and with the use of slides for the adjustments. It must be appreciated that each time an adjustment is desired, two knobs must be turned to release both sides and slidable displacement must be produced on both sides simultaneously. It is well known that such simultaneous sliding on both sides is not easy to achieve and to control and at best, it needs both hands while one hand would also be needed to hold the non-movable part or parts. There results that such assembly is difficult to adjust and the adjustments must be made before use, since during use, it is almost impossible for one person to handle the situation. This is particularly important, since such stand is specifically intended to be used by sick, old or handicapped persons whose hands are not that reliable.

The U.S. Pat. No. 2,501,019 to Attick defines a stand of the above mentioned type, which is also characterized by a mode of adjustment of the inclination that is not easy and that also substantially precludes adjustment during use, since it is then almost impossible to properly engage the ends 9 in the sleeves 7.

Besides, none of the previous stands defines a convenient way to adequately support and position a newspaper relative to the field of vision nor allows to collapse the worktable panels in flat position, in particular while it is being used.

OBJECTS OF THE INVENTION

It is a general object of the present invention to provide a laptop reading and writing stand which substantially avoids the above-mentioned disadvantages of the previous stands of this type.

It is an otherwise-stated general object of the present invention to provide a laptop reading and writing stand which can easily and readily be operated by the user without having to disturb what rests on it to adjust its inclination and even to collapse it to a completely-flat position to use it as a table.

It is a more specific object of the present invention to provide a laptop reading and writing stand that is particularly adapted to be multifunctional, such as to support a book but to also conveniently support and position a newspaper to read it and to support papers to write on them.

DETAILED DESCRIPTION OF THE ILLUSTRATED EMBODIMENT

Figure 1:
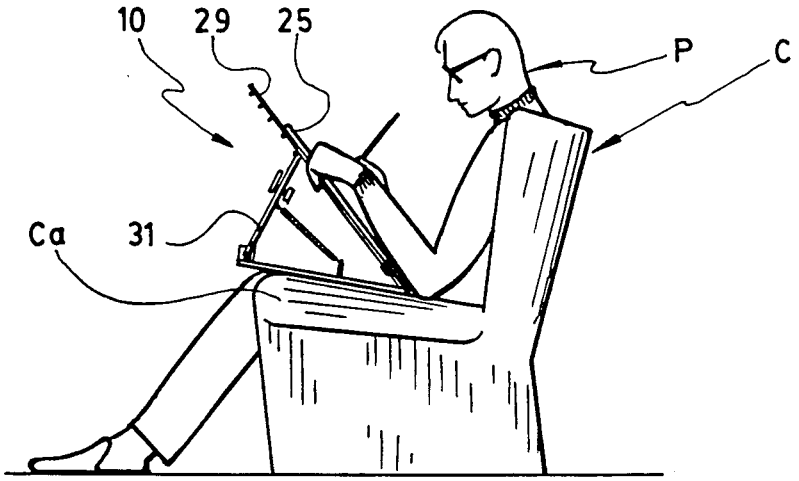
FIG. 1 is a side view of a sitting person using a laptop reading and writing stand according to the present invention.
Figure 2:
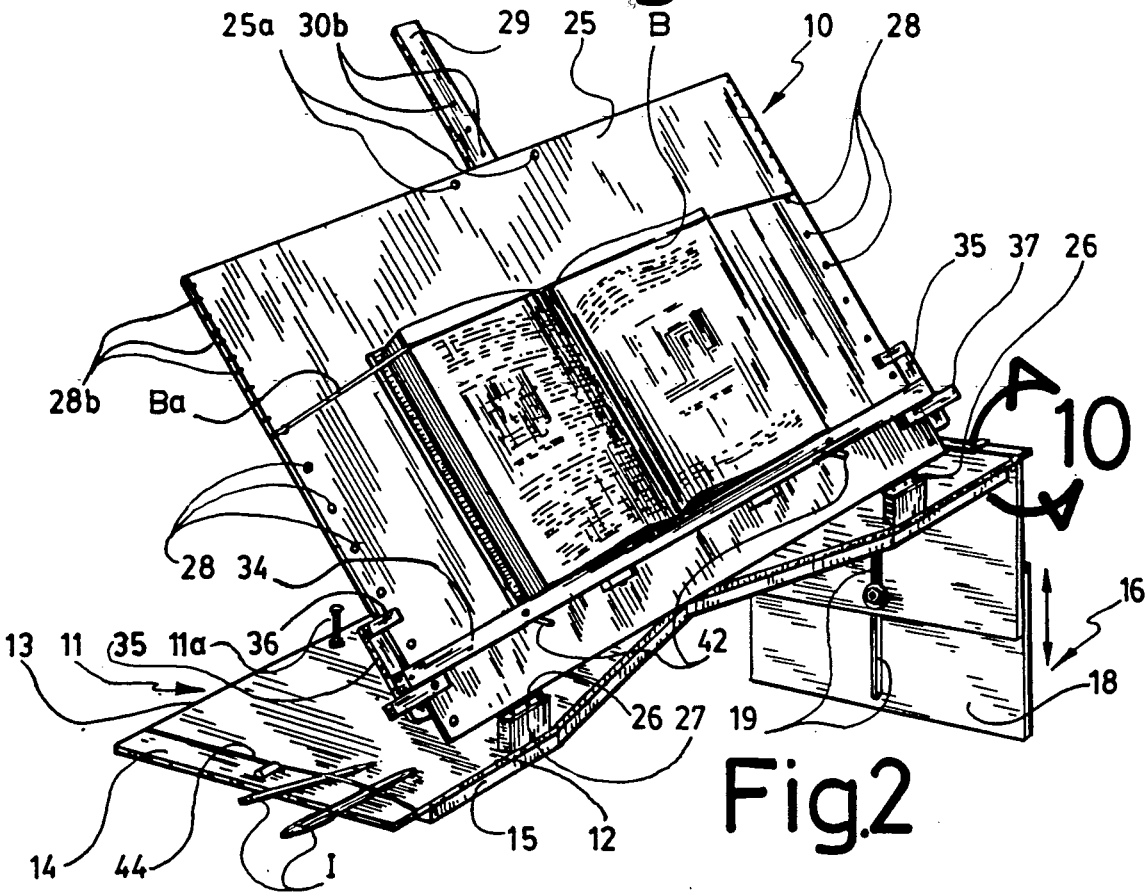
FIG. 2 is a perspective view of the laptop reading and writing stand of FIG. 1.

In FIG. 1, there is shown a person sitting in a chair C and using a laptop reading and writing stand 10 according to the present invention. The stand 10 includes a base panel 11 defining a front edge 12 and a rear edge 13. The front edge, as seen in FIG. 2, forms an inward broken line produced by a central cutout of the front edge portion of the base panel to allow placing the stand 10 closer to the user, since it provides space for its abdomen. The base panel 11 includes a top layer 14 and an underlayer 15. The latter is made of resilient foam to provide a soft and slipless padding resting on the lap of the user.

Figure 10:
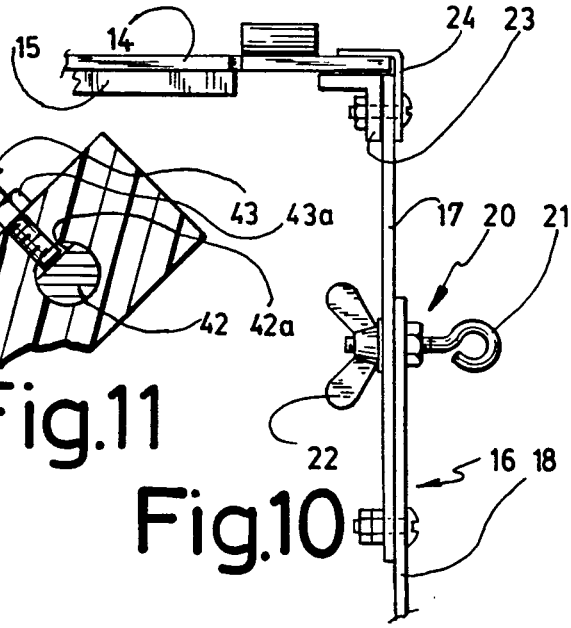
FIG. 10 is a detail view in elevation of a portion of FIG. 2 indicated by curved arrows 10.

An adjustable leg 16, as seen in FIGS. 2 and 10, can be removably fitted to either end of base panel 11 to transversely level the base panel and, thus, the whole stand when the user sits on a chair C having only one arm-rest Ca or on a sofa with two arm-rests spaced apart a greater distance than the width of the chair. One end of base panel 11 rests directly on arm-rest Ca (FIG. 1) while leg 16, fitted to the opposite end of base panel 11 rests directly on the seat portion of chair C. The leveling leg 16 includes an uPPer portion 17 and a lower portion 18, each taking the form of a panel with a vertical adjustment slot 19 substantially centered transversely in it. A bolt 20, having a hook-like head 21 and a wing nut 22, is engaged through the two adjustment slots 19 and allows up-and-down movement of the leg portions 17 and 18 relative one to the other. The upper end of the upper leg portion 17 is provided with a pair of angles 23 and 24 adapted to frictionally engage either one of the two lateral edges of the base panel 11.

Figures 3, 3A, 4, 5, 7:
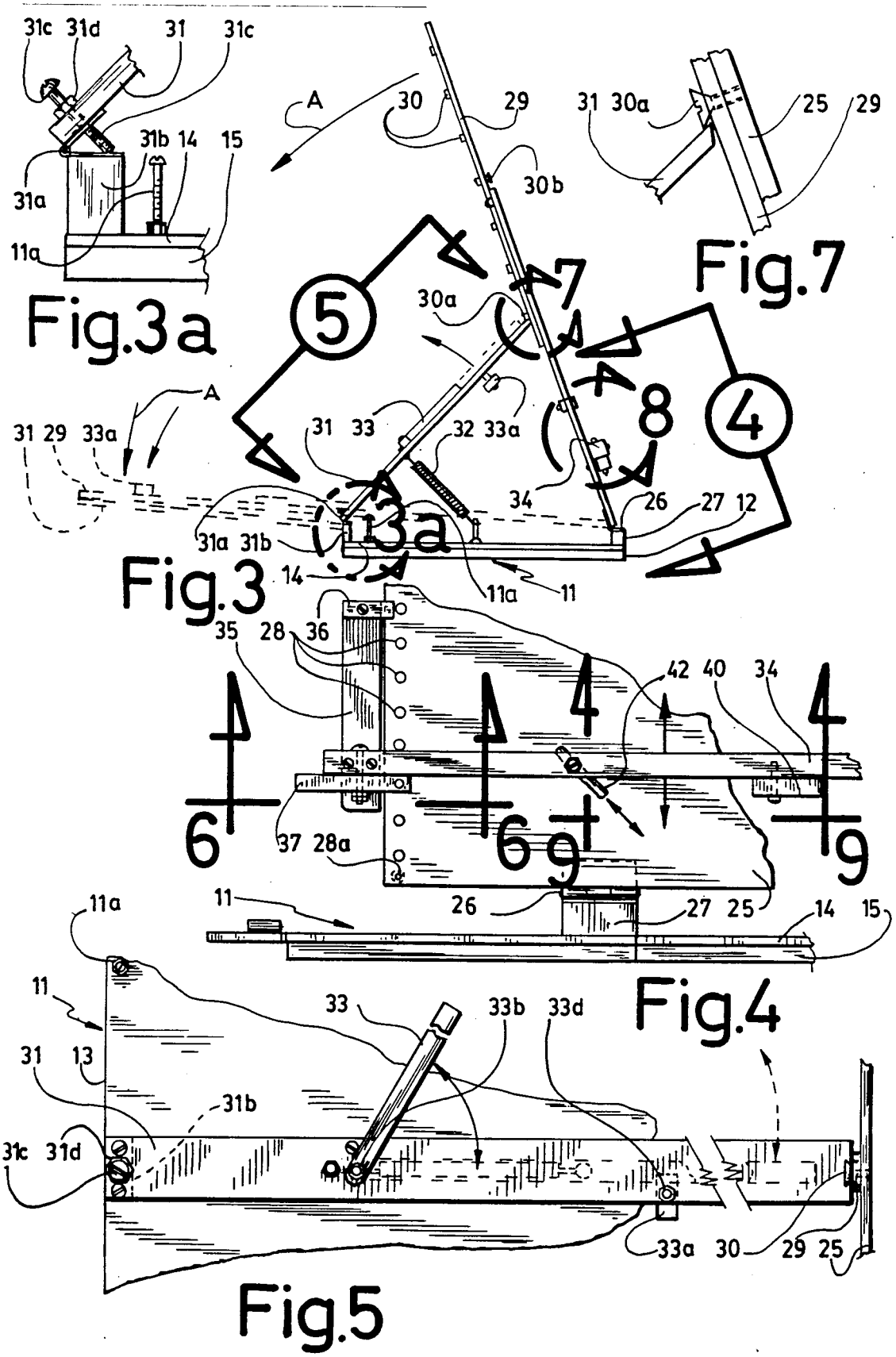
FIG. 3 is a lateral elevation view of the same laptop reading and wr stand illustrating the collapsing thereof to a flat position.
FIG. 3*a* is an enlarged elevation of the hinge encircled in circe 3*a* of FIG. 3.
FIGS. 4 and 5 are detail views as seen in the direction of the arrows 4 and 5 in FIG. 3.
FIG. 7 is an enlarged view of the detail encircled by the curved arrows 7 in FIG. 3.

A rectangular worktable panel 25 is pivotally mounted on the base panel by a pair of hinges 26, each mounted on a block 27. These blocks and hinges are mounted on the front edge portion of the base panel and aligned along the front edge 12. The worktable panel 25 has parallel lateral edges with a series of holes 28 along each lateral edge. A bar 29 is secured against the rear face of the worktable panel 25 substantially centrally relative to its transverse direction and protrudes from the top edge of panel 25. A series of screws 30 are screwed into the bar 29 in the forward direction and such as their heads remain in rearward projection, as seen in FIGS. 3 and 7. The screws 30 are equally spaced apart along the bar 29 and are serially aligned away from the front edge of base panel 11, in the fore-and-aft direction.

An adjustment leg 31 is provided to adjust the inclination of the worktable panel 25. A hinge 31*a*, mounted on a block 31b, pivotally secures the lower end of the inclination adjustment leg 31 on the rear edge portion of the base panel. That hinge, and thus the inclination adjustment leg 31, are centered transversely of the stand in alignment with the series of stoppers formed by the heads of the screws 30. The upper end of the inclination adjustment leg 31 selectively and freely engages against one of the stoppers defined by the heads of the screws above the base panel. The inclination of the worktable panel 25 may thus be selectively set by resting of the latter against the upper end of the leg 31 and engagement with one or another of the screws or stoppers 30 incuding the lowermost stopper 30*a*.

A tension coil spring 32 joins the leg 31 to the base panel 11 and operatively biases the leg against the worktable panel 25. An arm 33 is pivoted at 33*b* on the rear face of the inclination adjustment leg and is pivotable into a laterally projecting position to allow one hand to grasp around one side of panel 25 the actuation arm behind the panel 25 to push the leg 31 rearwardly against the action of spring 32 and, thus, easily decrease the inclination of the worktable panel relative to the horizontal as indicated by arrow A. In order to do this, the worktable panel is first slightly pulled forwardly by the user's other hand grasping bar 29, in order to release leg 31 from a stopper 30. To increase the inclination of worktable panel 25, the latter is simply pulled towards the user with one hand to the desired extent, leg 31, which is biased against the back of bar 29 simply slides along the latter and over one or more stoppers 30. Once released, panel 25 pivots back sligthly under its own weight until leg 31 again engages the nearest stoper 30. In the nearly upright limit position of panel 29 shown in FIG. 3, spring 32 exerts only a slight tension. In all other less inclined positions, the force exerted by spring 32 is always less than the force tending to fold panel 29 due to its gravity. Thus leg 31 positively engages any selected stopper 30 or 30*a*. A bolt 31*c* extends through leg 31 and abuts against block 31*b* when leg 31 is inclined to engage under the lowermost stop 30*a* thus preventing leg 31 from biasing the worktable panel 29 towards upright position under spring tension. The stop bolt 31*c* is adjusted and then locked by a locknut 31*d*.

As can be seen in dotted lines in FIG. 3, when the outer end of the leg 31 moves past the outermost stopper 30 of bar 29, the worktable panel 25 is allowed to fully collapse to a flat table position, suitable for writing. Panel 25 is laterally stabilized in writing position by resting on a pair of stops 11*a* (FIGS. 2 and 3) fixed to and upwardly protruding from base panel 11. A catch lever 33*a* is pivoted at 33*d* to bar 31 and serves to overlap bar 29 in the fully collapsed position of panel 25 in order to retain the latter in said position for storage of the whoe assembly in a flat container. Pivots 33*b* for arm 33 and 33*d* for catch lever 33*a* consist of a bolt and locknut to adjust and retain a suitable friction between leg 31 and arm 33 and lever 33*a*. Therefore, the two latter elements remain in their last pivoted position.

Figure 6:
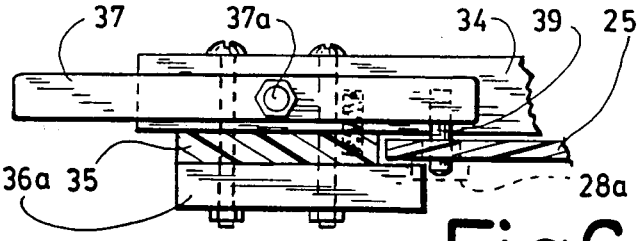
FIGS. 6 and 6*a* are detail sectional views as seen in the direction of the arrows 6—6 in FIG. 4 and illustrating a catch assembly in engaged and disengaged positions, respectively.
Figure 6A:
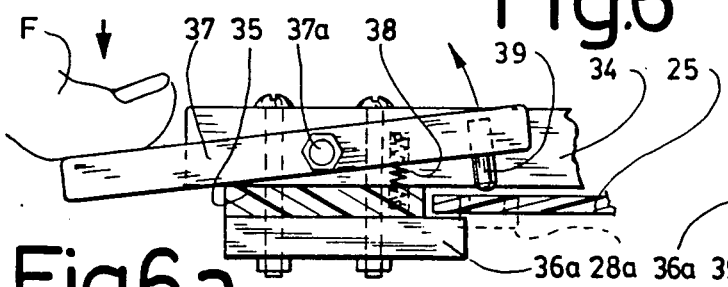
Figure 8:
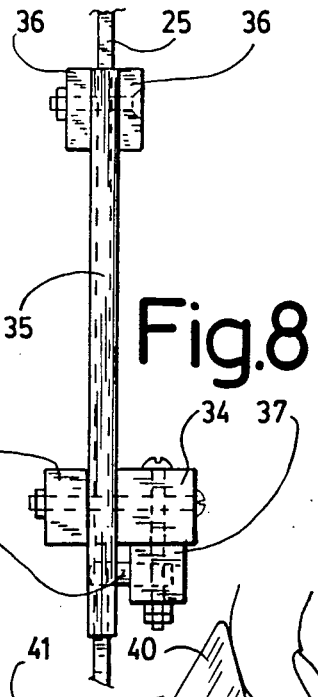
FIG. 8 is a lateral view of a slide assembly and an associated catch seen in enlarged scale as compared to the encircled portion indicated by the curved arrows 8 in FIG. 3.

A workholder bar 34 extends transversely over the front face of the worktable panel 25. A pair of slides operatively carry the opposite ends respectively of the workholder bar 34 slidably along the opposite lateral edges of the worktable panel 25. Each slide includes an elongated panel edge guide 35, guide members 36, 36*a* transversely projecting from the upper end and the lower end of the edge guide 35, members 36 over and under the corresponding lateral edge portion of the worktable panel 25 and member 36 under the corresponding lateral portion. The slide components are assembled by bolts, as best shown in FIGS. 4, 6, and 6*a*. The workholder bar 34 is thus arranged to be spaced above the front face of the worktable panel.

A catch device is provided at each end of the workholder bar 34 and essentially includes a lever 37 pivoted at 37*a* to bar 34, a tension spring 38, and a pin 39 projecting from the lever 37 to engage in one of the holes 28. As shown by a user's finger F in FIG. 6*a*, the catch devices may be released by pressing down on the outer end of the levers 37. The workholder bar 34 is thus free to slide up and down over the worktable panel 25.

A stop 28*a* is fixed to and protrudes from the back face of panel 25 below each row of holes 28 (FIGS. 4, 6) and in the path of guide members 36*a* to prevent holder bar 34 from sliding off the bottom of worktable panel.

Figure 9:
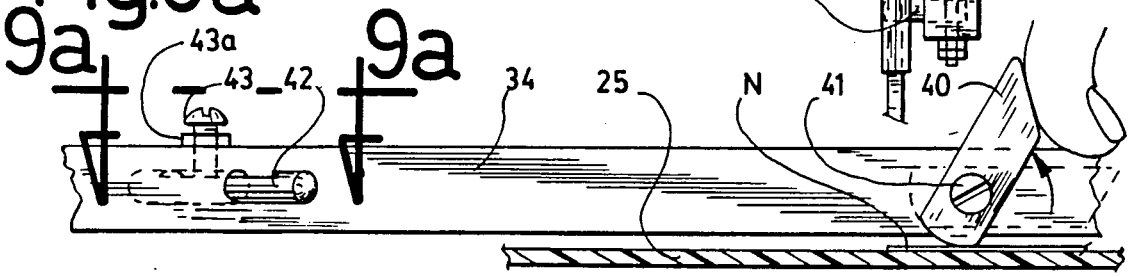
FIG. 9 is a partial cross-sectional view as seen along line 9—9 in FIG. 4.
Figure 9A:
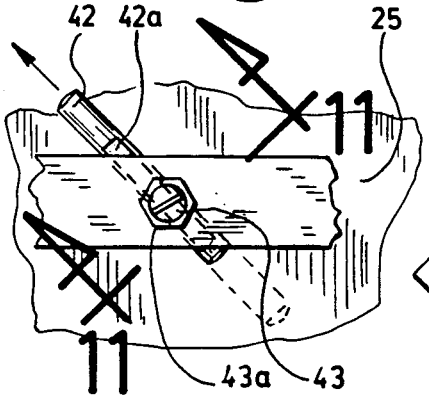
FIG. 9*a* is a plan view of a portion of the workholder bar illustrating an adjustable holding finger taken on line 9*a*—9*a* of FIG. 9.
Figure 11:
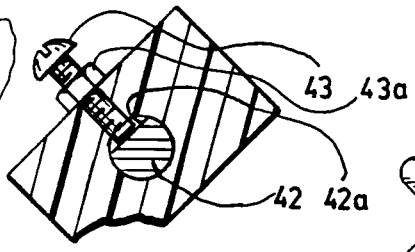
FIG. 11 is a cross-sectional view as seen along line 11—11 in FIG. 9*a*.

A book B is normally positioned by resting it against the upper lateral edge of the workholder bar 34 Book B is kept open at the desired page by a rubber band Ba surrounding the book and panel 25. To clear book B, band Ba is stretched and hooked onto the protruding head of screw 30*b*. Band Ba is releasably retained in any selected pair of side grooves 28*b* made in the side edges of panel 25. Writing paper N, as shown in FIG. 9, is placed under the workholder bar 34 and is held in the desired position by a pair of pressing levers 40 pivoted by a screw 41 against the lower side of the bar. The pressing levers 40 are formed with a curved end to cammingly engage the paper. One can write on paper N, panel 25 being set to nearly horizontal position.

A pair of fingers 42 are slidable within inclined holes of the workholder bar 34. A screw 43 is adjustably screwed in bar 34 and locked by a locknut 43*a* to frictionally engage a recessed flat face 42*a* of finger 42 to stop movement of the latter to an upper and to a lower limit position. When manually pushed to its upper limit position in which it projects upwardly from bar 34, finger 42 serves to retain on bar 34 the lower edge of a newspaper (not shown) inserted between panel 25 and bar 34. When not used, fingers 42 are pushed to their lower limit position in which they protrude from underneath bar 34 only. Fingers 42 are retained by friction in either position. This position is adjusted by screwing screws 43 more or less against fingers 42. FIG. 2 also shows an elastic band 44 surrounding base panel 14 and writing implements I for releasably retaining the latter on panel 14 ready for use. Writing implements I can be conveniently and releasably inserted into top holes 25*a* made in Panel 25.

I claim:

1. A laptop reading and writing stand comprising a base panel defining a front edge portion and a rear edge portion, a worktable panel having a front and a rear edge and top and bottom main walls and pivotally secured to the base panel at the front edge thereof and operatively defining therewith a front pivot axis, a series of stoppers secured against said bottom wall of the worktable panel and serially extending away from the front edge portion of the base panel towards said rear edge of the worktable panel, an elongated inclination adjustment leg having a lower end pivotally secured to the base panel at the rear edge portion thereof and an upper end selectively and freely abutting against one of the stoppers above the base panel and said pivot axis and constructed and arranged to pivotally rest the worktable panel substantially transversely thereon, and a workholder bar, extending transversely over said top wall of the worktable panel for supporting a document in open condition to be read by a person facing said panel top wall, and having a catch device mounted on each end thereof and constructed and arranged to catchingly and adjustably engage the worktable panel along the opposite lateral edges thereof; a first hinge pivotally securing the inclination adjustment leg on the base panel in transverse registry with the series of stoppers and centrally relative to the opposite lateral edges of the worktable panel; biasing number extending between and attached to said adjustment leg and to said base panel and biasing said adjustment leg against said bottom wall of said worktable panel; further including an elongated support bar, fixed flatly against said bottom wall of said worktable panel and extending beyond the rear edge thereof, said support bar extending about a plane substantially parallel to that of said worktable panel so as to be substantially coextensive therewith, said elongated support bar being coplanar with said inclination adjustment leg and destined to extend along a lengthwise axis substantially transverse to the lengthwise axis of said elongated inclination adjustment leg, said support bar carrying said stoppers, some of said stoppers fixed to the portion of said support bar projecting beyond said worktable panel rear edge; wherein said person, in order to at least modify and fully adjust the inclination of said worktable panel from his reading position facing said panel top wall, needs only to hand grasp and pull toward him the free projecting end of said support bar, so as to release said adjustment leg from said stopper engaged by same, without having to reach out through and beyond the general plane of said worktable panel to said bottom wall thereof, and then to tilt said worktable panel freely over the released adjustment leg.

2. A laptop reading and writing stand as defined in claim 1, further including a leveling leg, removably attachable to either one of the two lateral edges of the base panel and selectively extendable to laterally support and level the base panel relative to a support surface underlying said one lateral edge; wherein said leveling leg includes an upper portion, removably attachable to said one lateral edge of the base panel, and a lower portion, slidably adjustable upwardly and downwardly relative to the upper portion.

* * * * *